US005211150A

United States Patent [19]

Anzai

[11] Patent Number: 5,211,150

[45] Date of Patent: May 18, 1993

[54] FUEL SUPPLY APPARATUS FOR INTERNAL COMBUSTION ENGINE

[75] Inventor: Makoto Anzai, Kanagawa, Japan

[73] Assignee: Nissan Motor Co., Ltd., Yokohama, Japan

[21] Appl. No.: 760,282

[22] Filed: Sep. 16, 1991

[30] Foreign Application Priority Data

Sep. 19, 1990 [JP] Japan ..... 2-47361

[51] Int. Cl.[5] ..... F02D 41/34

[52] U.S. Cl. ..... 123/480; 123/478; 123/585

[58] Field of Search ..... 123/478, 480, 486, 488, 123/494, 336, 585

[56] References Cited

U.S. PATENT DOCUMENTS 4,688,533 8/1987 Otobe ..... 123/336
4,791,569 12/1988 Suzuki ..... 364/431.04
4,886,030 12/1989 Oba et al. ..... 123/488

FOREIGN PATENT DOCUMENTS 3609070 9/1986 Fed. Rep. of Germany .
55-148932 11/1980 Japan .
58-23245 2/1983 Japan .
60-169647 9/1985 Japan ..... 123/494
62-101868 5/1987 Japan .
2-230942 9/1990 Japan ..... 123/478

OTHER PUBLICATIONS

Toyota Engine 4V-EU E-VG System Troubleshooting Manual (1978) pp. 1-16.

*Primary Examiner*—Andrew M. Dolinar
*Attorney, Agent, or Firm*—Lowe, Price, LeBlanc & Becker

[57] ABSTRACT

The fuel supply apparatus for a multiple-cylinder internal combustion engine is comprised of a fuel supply means through which a fuel amount is injected into each combustion chamber of the engine. The fuel amount is corrected by fuel supply amount correcting means in a controller of the fuel supply apparatus, in accordance with intake port pressure near the fuel supply means to maintain a proper fuel injection even in various intake pressure conditions. The intake port pressure is estimated by intake port pressure estimating mean in the controller to search a data map in the intake port pressure estimating means, in accordance with an engine speed, an opening degree of the throttle valve, and an crankangle at the fuel injection start time.

9 Claims, 8 Drawing Sheets

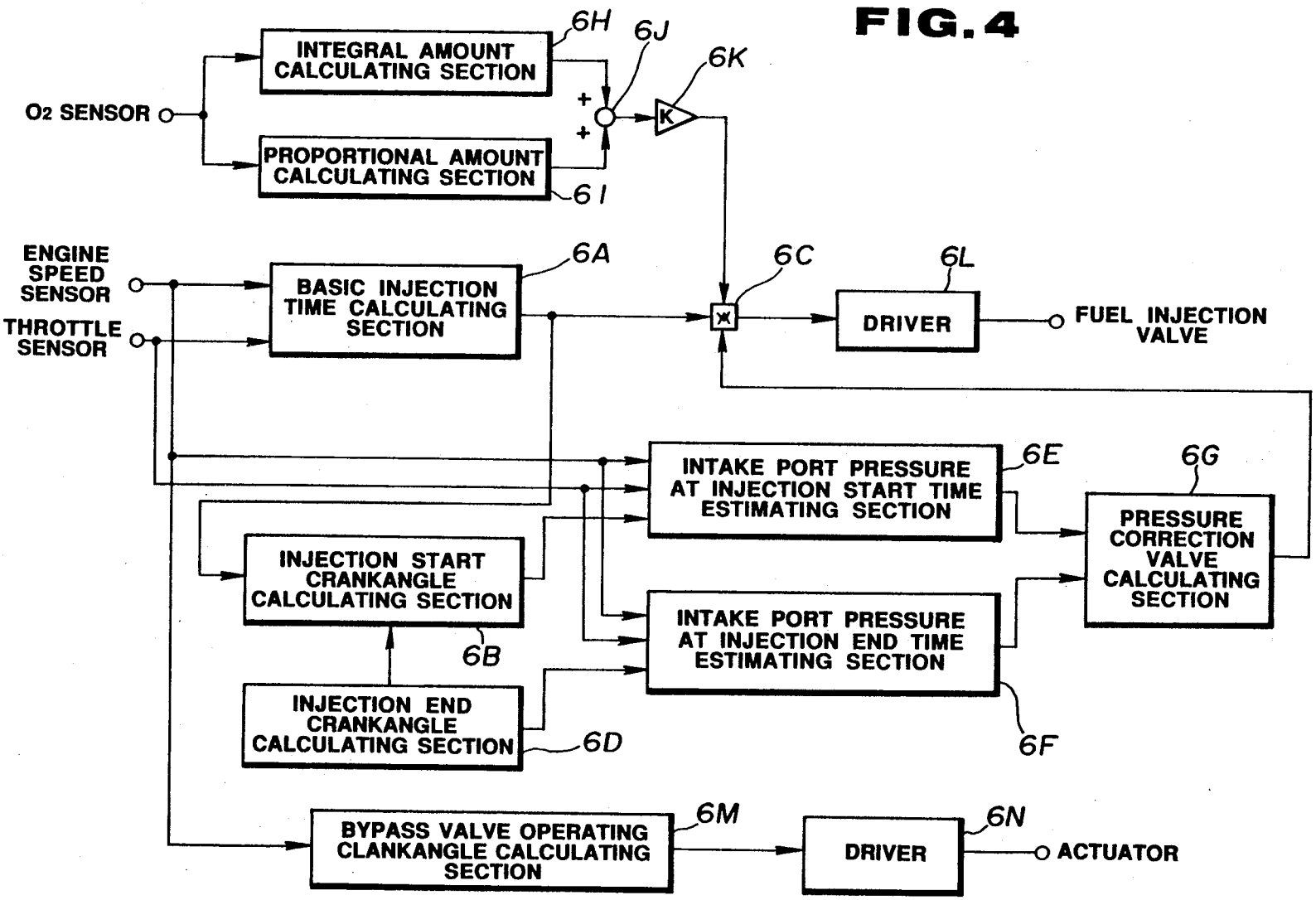
FIG. 4
INTEGRAL AMOUNT CALCULATING SECTION
PROPORTIONAL AMOUNT CALCULATING SECTION
BASIC INJECTION TIME CALCULATING SECTION
INJECTION START CRANKANGLE CALCULATING SECTION
INJECTION END CRANKANGLE CALCULATING SECTION
INTAKE PORT PRESSURE AT INJECTION START TIME ESTIMATING SECTION
INTAKE PORT PRESSURE AT INJECTION END TIME ESTIMATING SECTION
PRESSURE CORRECTION VALVE CALCULATING SECTION
BYPASS VALVE OPERATING CLANKANGLE CALCULATING SECTION
DRIVER
DRIVER
FUEL INJECTION VALVE
ACTUATOR
O2 SENSOR
ENGINE SPEED SENSOR
THROTTLE SENSOR
6H
6I
6J
6K
6A
6B
6C
6D
6E
6F
6G
6L
6M
6N

FUEL SUPPLY APPARATUS FOR INTERNAL COMBUSTION ENGINE

BACKGROUND OF THE INVENTION

1. Field of the Invention

The present invention relates to improvements in a fuel supply apparatus for an internal combustion engine, and more particularly to a fuel supply control apparatus which supplies an adequately controlled mixture of air and fuel to each cylinder.

2. Description of the Prior Art

It is well known that automative vehicles are provided with fuel supply apparatus by which an air-fuel ratio is controlled and supplied to each cylinder. A typical fuel supply apparatus is, for example, disclosed in Japanese Provisional Publication Nos. 55-148932 and 58-23245. Such a fuel supply apparatus is provided with an opening-closing valve in the vicinity of an intake valve of an internal combustion engine. The opening-closing valve is operated to control an intake air flow rate fed to a combustion chamber of the engine to improve the pumping loss of the engine.

On the other hand, to improve the irregularity of the air-fuel ratio among the cylinders of the engine, a fuel supply apparatus is disclosed in Japanese Provisional Publication No. 62-101868. Such fuel supply apparatus includes a pressure sensor which is installed proximate each intake port to respectively detect each intake pressure. The fuel supply amount to each cylinder is corrected in accordance with the detected intake pressure. However, although the irregularity of the air-fuel ratio among the cylinders is improved by the installation of such a pressure sensor to each cylinder, the production cost of the engine is largely raised.

SUMMARY OF THE INVENTION

It is an object of the present invention to provide an improved fuel supply apparatus which improves an irregularity of the air-fuel ratio among the cylinders of an internal combustion engine by controlling the fuel supply amount.

Another object of the present invention is to provide a fuel supply apparatus which controls the fuel supply amount by changing a fuel injection time in accordance with the intake port pressure in the vicinity of a fuel injection valve without a pressure sensor for detecting the intake port pressure.

A fuel supply apparatus in accordance with the present invention is for an internal combustion engine which has a throttle valve in an intake passage thereof. The fuel supply apparatus comprises fuel supply means which is disposed in the intake passage downstream of the throttle valve and which supplies fuel into the intake passage. Fuel supply amount deciding means decides a fuel supply amount in accordance with the operating condition of the engine. Intake port pressure estimating means estimates an intake port pressure in the intake passage downstream of the throttle valve in accordance with the engine operating condition. Fuel supply amount correcting means corrects the fuel supply amount in accordance with the intake port pressure estimated by the intake port pressure estimating means. Drive controlling means controls to drive the fuel supply means in accordance with the corrected fuel supply amount.

With this arrangement, since the fuel injection to each cylinder is carried out upon the correction of the basic injection time in accordance with the estimated intake port pressure, the air-fuel ratio of each cylinder corresponds to each other and is controlled at a proper value even if the engine has the irregularity of the sealing performance and/or assembling accuracy among the cylinders. Furthermore, since this apparatus has a function to estimate the intake port pressure without an intake port pressure sensor, the production cost of the engine is largely suppressed.

BRIEF DESCRIPTION OF THE DRAWINGS

In the drawings, like reference numerals designate like elements and parts throughout the figures, in which:

FIG. 4 is a structural block diagram showing an embodiment of the hardware of a controller of the fuel supply apparatus according to the present invention;

DETAILED DESCRIPTION OF THE INVENTION

Figure 1:
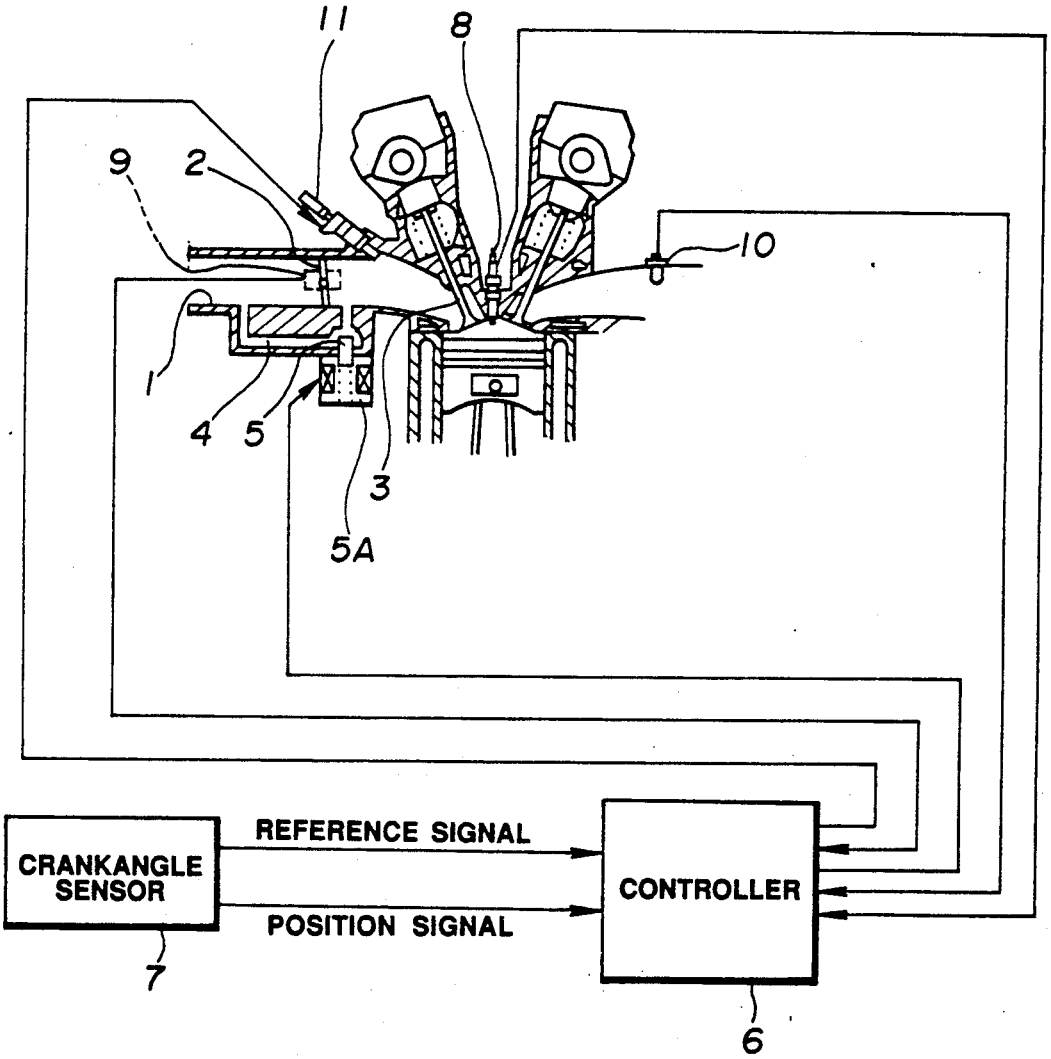
FIG. 1 is a system diagram of an embodiment of a fuel supply apparatus for an internal combustion engine in accordance with the present invention.
Figure 2:
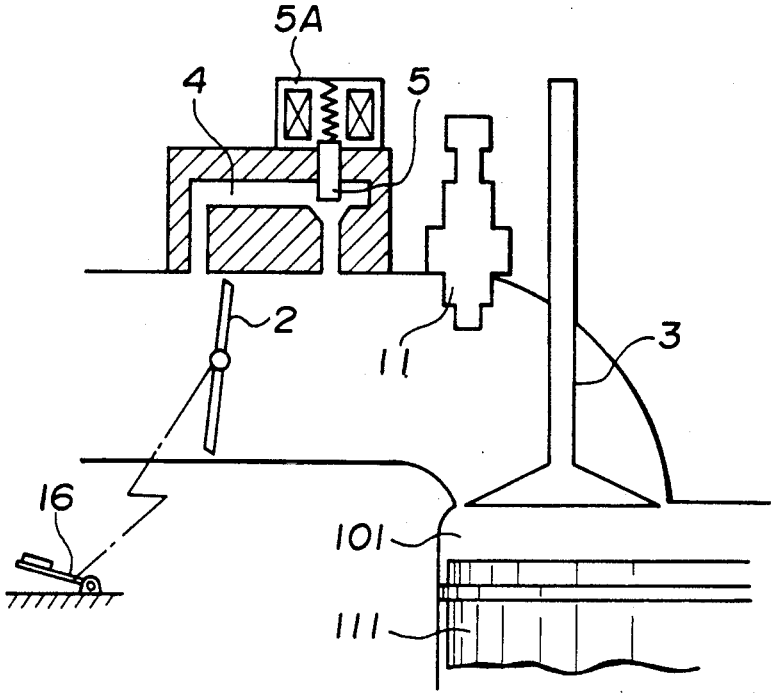
FIG. 2 is a partial cross-sectional view of an intake system of the engine applying the fuel supply apparatus in accordance with the present invention.
Figure 3:
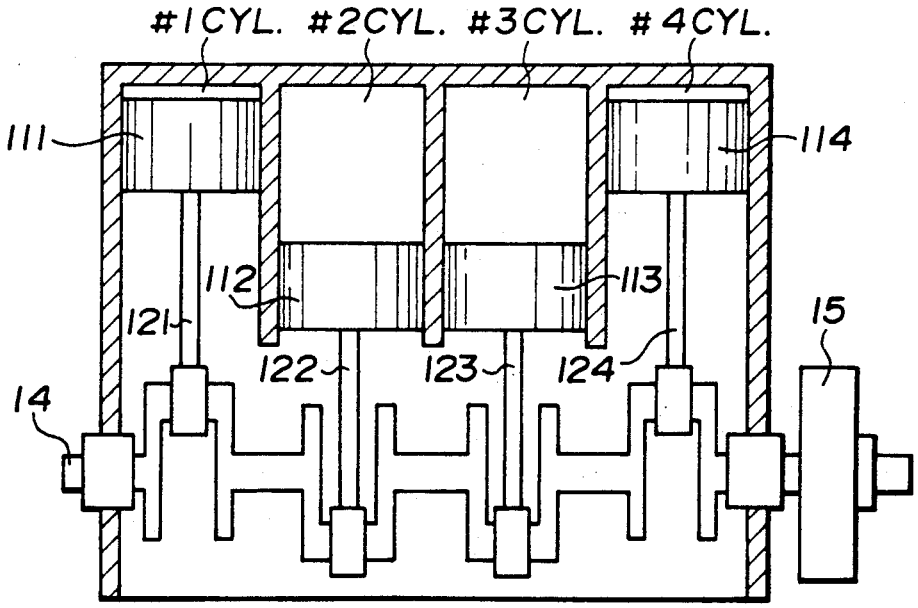
FIG. 3 is a schematic cross-sectional view of the engine of FIG. 2.

Referring now to FIGS. 1 to 9, there is shown an embodiment of a fuel supply apparatus which is installed to an internal combustion engine. The internal combustion engine has four combustion chambers 101, 102, 103, and 104, each of which is defined by a cylinder #1, #2, #3, #4 with a fixed and closed one end and a movable piston 111, 112, 113, 114 at the other end. The four cylinders #1, #2, #3, and #4 are in a line, and their pistons 111, 112, 113, and 114 are connected to a common crankshaft 14. Each cylinder has a fuel injection valve 11. The mixture of air and fuel in each cylinder is compressed by the piston and is ignited by means of an electric spark at a timing near the end of the compression stroke. The four cylinders #1, #2, #3, and #4 are fit with pistons 111, 112, 113, and 114. These are connected to the crankshaft 14 by means of connecting rods 121, 122, 123, and 124. A flywheel 15 is mounted on one end of the crankshaft 14 and rotates therewith. Power or expansion strokes in the different cylinders are timed in the order of #1-#4-#3-#2 with consecutive power strokes being spaced apart by 180° of the crankshaft travel.

The mixture of fuel and air is fed to each combustion chamber through each intake port 1 which is independently formed and provided therein with a throttle valve 2 which is directly or indirectly connected to an accelerator or gas pedal 16 such that the opening degree of the throttle valve 2 is changed in response to the changing of the depression degree of the accelerator 16 which is manually operable. An intake valve 3 is disposed downstream of the throttle valve 2 to close the combustion chamber. A bypass passage 4 is formed to bypass the throttle valve 2 and installs an opening-closing valve (or bypass valve) 5 therein for opening and closing the bypass passage 4. The opening-closing valve 5 is driven by an actuator 5A of an electromagnetic type in accordance with the signal from a controller 6. The volume of the intake passage 1 from the throttle valve 2 to the intake valve 3 is set to be ½ of the maximum volume of the combustion chamber (such as a case in which the piston is located at a bottom dead point).

The controller 6 receives a reference signal and a position signal from a crankangle sensor 7. The reference signal is generated at every 180° of the rotation of the crankshaft 14 and the position signal is generated at every 1° of the rotation of the crankshaft 14. Furthermore, the controller 6 receives a signal outputted from a combustion chamber pressure sensor (not shown) embedded in the bottom metal portion of each spark plug 8, and a signal indicative of the oxygen density which is outputted from an $O_2$ sensor 10 disposed in an exhaust passage (no numeral).

As shown in FIG. 4, there is shown an embodiment of a hardware of the controller 6. The hardware includes a first calculating section (a basic injection time calculating section) 6A which calculates a basic fuel injection time in accordance with the engine speed and the opening degree of the throttle valve 2. The first calculating section 6A outputs a signal indicative of the basic fuel injection time to a multiplier 6C and a second calculating section (an injection start crankangle calculating section) 6B. The second calculating section 6B calculates a crankangle at a fuel injection start time in accordance with the signal from the first calculating section 6A, and outputs a signal indicative of the crankangle at the fuel injection start time to a first estimating section (an intake port pressure estimating section) 6E. The first estimating section 6E estimates an intake port pressure at the fuel injection start time (a first pressure) in accordance with the engine speed and the opening degree of the throttle valve 2. A second estimating section (an intake port pressure estimating section) 6F estimates an intake port pressure at the fuel injection end time (a second pressure) in accordance with the engine speed and the opening degree of the throttle valve 2. A fourth calculating section (a pressure correction value calculating section) 6G calculates a pressure correction value in accordance with an averaged value between the first pressure and the second pressure (the intake port pressure a the injection start time and the intake port pressure at the injection end time).

An integral amount calculating section 6H calculates an integral amount of the air-fuel ratio in accordance with the signal from the $O_2$ sensor 10. A proportional amount calculating section 6I calculates a proportional amount of the air-fuel ratio in accordance with the signal from the $O_2$ sensor 10. An adder 6J calculates an air-fuel ratio correction value by adding the integral amount and the proportional amount, and outputs a signal indicative of the air-fuel ratio correction value to a multiplier 6K. The mulitplier 6K corrects the air-fuel ratio correction valve by multiplying a constant number to the air-fuel ratio correction value. The multiplier 6C calculates a fine fuel injection period by multiplying the basic fuel injection time, the pressure correction value, and the air-fuel ratio correction value, and outputs a signal indicative of the fine fuel injection period to a driver 6L. The driver 6L controls the fuel injection valve 11 in accordance with the fine fuel injection period.

On the other hand, a fifth calculating section (a bypass valve operating crankangle calculating section) 6M calculates a crankangle at which the opening-closing valve 5 is open in accordance with the engine speed, and outputs a signal indicative of the opening-closing valve operating crankangle to a driver 6N. The driver 6N operates the opening-closing valve 5 by controlling an actuator 5A, in accordance with the calculated crankangle for the bypass valve 6N.

The manner of operation of the thus arranged fuel supply apparatus will be discussed hereinafter with reference to a flow chart of FIGS. 5 and 6.

Figure 5:
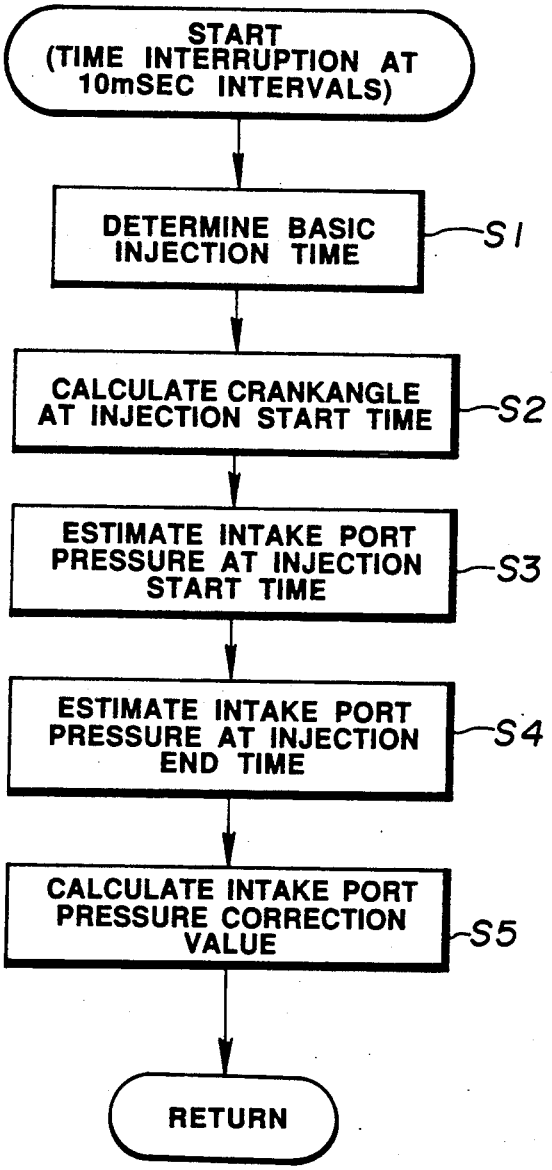
FIG. 5 is a flow chart showing a program of the fuel supply apparatus according to the present invention.

The routine of the flow chart in FIG. 5 is carried out to each cylinder at predetermined time intervals (such as 10 msec.) by the synchronous processing and in response to a position signal from the crankangle sensor 7.

In a step S1, the controller 6 calculates a basic injection time (basic injection amount) which corresponds to a basic injection time on condition that the difference between the fuel pressure for supplying the fuel to the fuel injection valve 11 and the intake port pressure is generally constant, in accordance with the signals indicative of the opening degree of the throttle valve 2 and the engine speed.

Figure 9:
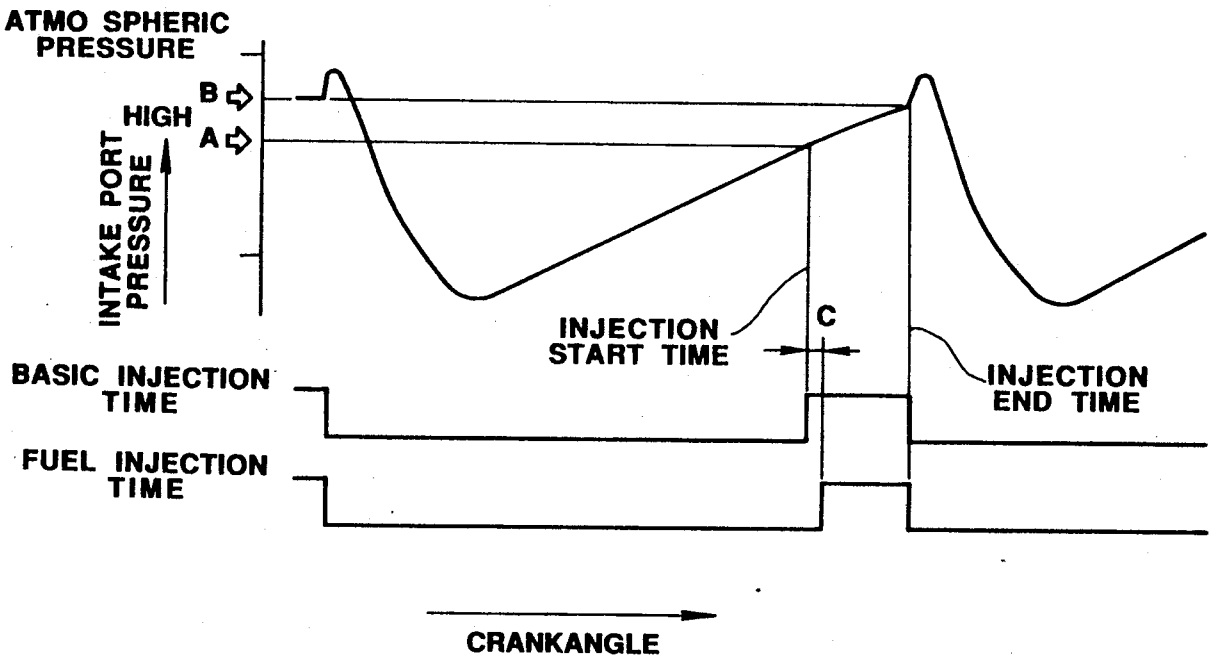
FIG. 9 is a graph showing a periodical change of the intake port pressure and the relationship of the basic injection time and the fuel injection time relative to the crankangle.

In a step S2, the controller 6 calculates a crankangle at which the fuel injection is started so that the fuel injection is finished just slightly before the intake valve is opened, in accordance with the basic fuel injection time calculated in the step S1, as shown in FIG. 9.

In a step S3, the controller 6 estimates an intake port pressure (first pressure) by searching a data map which represents a relationship between the basic intake port pressure at a starting point of the fuel injection and the crankangle at the starting point of the fuel injection. The timing when the first pressure is estimated is positioned at the point A in FIG. 9. That is to say, the intake port pressure at the basic fuel injection start time (the first pressure), which is in a condition that the throttle valve 2 is completely closed, is searched from the data map of FIG. 7 in accordance with the bypass valve opening degree, the engine speed, and the crankangle at the fuel injection start time. Furthermore, the correction value for the intake port pressure is searched from the data map of FIG. 8 in accordance with the bypass valve opening degree and the crankangle at the fuel injection start time. The intake port pressure at the fuel injection start time (the first pressure) is calculated by adding the correction value to the basic intake port pressure at the fuel injection start time.

Figure 7:
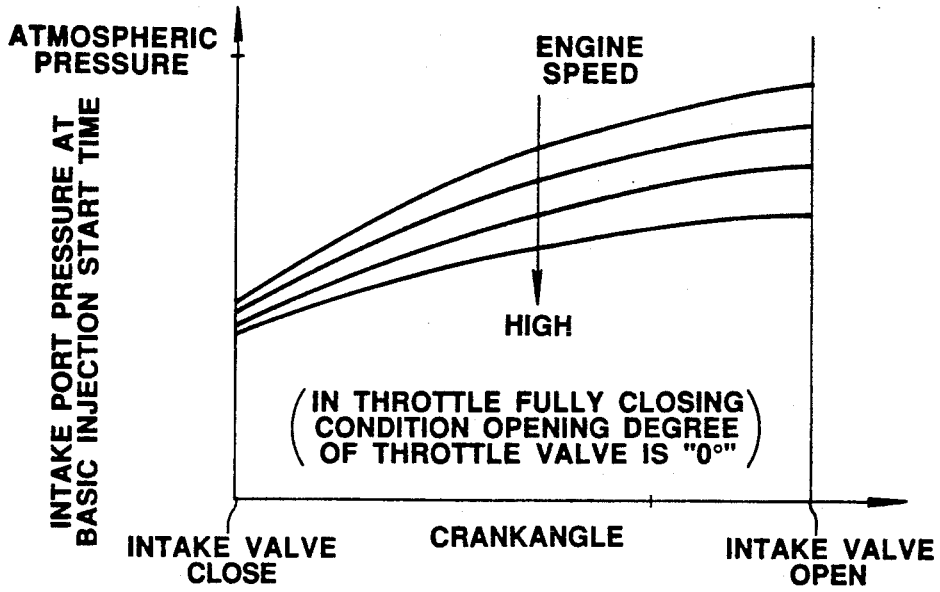
FIG. 7 is a data map of an intake port pressure at a basic injection start time in accordance with a crankangle and an engine speeds.
Figure 8:
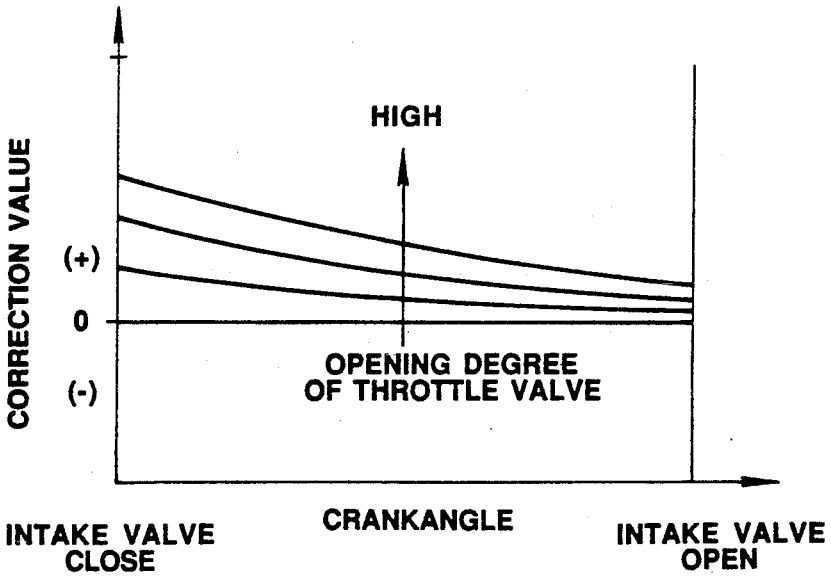
FIG. 8 is a data map of an correction valve for the fuel supply amount in accordance with the crankangle and the opening degree of the throttle valve.

In a step S4, an intake port pressure at the intake passage 2 downstream of the throttle valve 2 at the fuel injection end time (second pressure) is estimated by searching the data map similar to that in FIGS. 7 and 8 in accordance with the throttle valve opening degree and the engine speed. The timing when the second pressure is estimated is positioned at the point B in FIG.

9. That is to say, the intake port pressure at the fuel injection end (the second pressure), which is in a condition that the throttle valve is fully closed, is searched from the data map in accordance with the engine speed and the crankangle at the fuel injection end time, as being similar to the estimating of the intake port pressure at the fuel injection start time (the first pressure). Simultaneously, the pressure correction value is searched from the date map in accordance with the throttle valve opening degree and the crankangle at the fuel injection end time. Furthermore, the final intake port pressure at the fuel injection end time is calculated by adding the correction value to the basic intake port pressure at the fuel injection end time.

In a step S5, the average value between the intake pressure at the fuel injection start time (the first pressure) and the intake pressure at the fuel injection end time (the second pressure) is calculated, and the pressure correction value is calculated in accordance with this average value.

Figure 6:
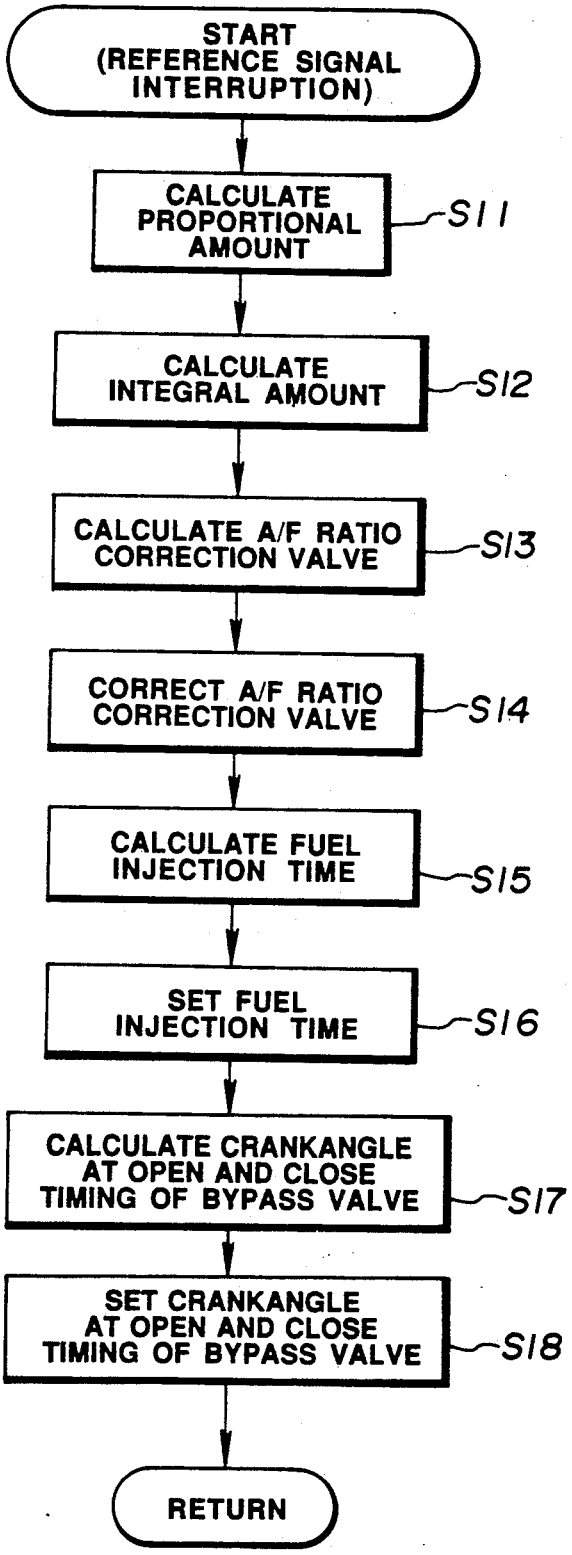
FIG. 6 is a flow chart showing further program of the fuel supply apparatus according to the present invention.

Furthermore, the routine of a flow chart in FIG. 6 is carried out to each cylinder in response to the reference signal by the synchronous processing.

In a step S11, a proportional amount of the air-fuel ratio is calculated in accordance with the signal from the $O_2$ sensor.

In a step S12, an integral amount of the air-fuel ratio is calculated in accordance with the signal from the $O_2$ sensor.

In a step S13, an air-fuel ratio correction value is calculated so as to approach the real air-fuel ratio to a theoretical ratio by adding a proportional amount and the integral amount.

In a step S14, a constant number is multiplied with the air-fuel ratio correction value so that the air-fuel ratio correction value is set into a proper value.

In a step S15, the fuel injection time is calculated by multiplying the basic fuel injection time, the pressure correction valve, and the air-fuel ratio correction value with each other.

In a step S16, the fuel injection time calculated in the step S15 is applied to the driver 6N to operate the fuel injection valve 11 in such a manner to finish the fuel injection at the fuel injection end crankangle.

In a step S17, the crankangle, at which the opening-closing valve 5 is opened, is calculated in accordance with the engine speed.

In a step S18, the bypass valve opening crankangle calculated in the step S17 is applied to the driver 6N. With this operation, the driver 6N drives the actuator 5A so that the bypass valve 5 is put in an opening state at the opening crankangle and in a closing state at the closing crankangle. That is to say, the bypass valve 5 is open in a period from a compression stroke to an combustion stroke, and the bypass valve 5 is closed for a period of an intake stroke. With this control of the bypass valve 5, the intake port pressure at a position downstream of the throttle valve 2 takes a value generally equal to atmospheric pressure at the time of the just opening of the intake valve 3 at every combustion stroke, as shown in FIG. 9. Then, the intake port pressure is lowered in correspondence with the intake stroke. Furthermore, the intake pressure is raised to atmospheric pressure for a period from a compression stroke to a combustion stroke. The bypass valve 5 installed in each cylinder is controlled so that the output torque of each cylinder takes the generally same value to each other.

With the thus arranged fuel supply apparatus, since the final injection time is decided by the correction of the basic injection time in accordance with the estimated intake port pressure, the air-fuel ratio of each cylinder corresponds to each other and is controlled at a proper value even if the engine has the irregularity of the sealing performance and/or assembling accuracy among the cylinders. Furthermore, since this apparatus has a function to estimate the intake port pressure without an intake port pressure sensor, the production cost of the engine is largely suppressed.

Additionally, since the opening-closing valve 5 is disposed in every bypass passage of the throttle valve 2, the volume of the intake passage downstream of the throttle valve 2 is designed to be ½ of the maximum volume of the combustion chamber, the opening-closing valve 5 is fully open so that the intake port pressure at a portion downstream of the throttle valve 2 takes a value close to atmospheric pressure in the event that the intake valve 3 is open, and the opening-closing valve 5 is set at a predetermined opening degree. Accordingly, the combustion chamber pressure at the time the intake valve has just opened is maintained at a pressure close to atmospheric pressure. Therefore, the combustion chamber pressure is generally linearly lowered from atmospheric pressure to a combustion chamber pressure at a B.D.P. of the piston in an idling (such as −550∼−570 mmHg). Therefore, the pumping loss is greatly suppressed as compared with the case of the conventional throttle valve control. This largely improves engine performance. Furthermore, the structure of this apparatus is largely simplified by controlling the the opening-closing valve 5 by the actuator 5A of the electromagnetic type.

In this apparatus, the volume of the intake passage 1 downstream of the throttle valve 2 to the intake valve 3 is defined to be smaller than or equal to ½ of the maximum volume of the combustion chamber. The reason of the above discussed structure is explained hereinafter.

When it is assumed that the engine is formed to satisfy the following condition; the maximum volume of the combustion chamber is X; the volume of the intake passage 1 from the throttle valve 2 to the intake valve 3 is Y; the compression ratio is 1:10; and the combustion chamber pressure is −456 mmHg at the time that the piston is located at the B.D.P. at an idling (In general, an engine of the high speed type takes such a pressure value since the engine is designed to increase a valve overlap period.), that is, when the total volume of the intake passage and the combustion chamber at a state of the U.D.P. of the piston is represented to be $(X/10+Y)$, and the total volume of the intake passage and the combustion chamber at a state of the B.D.P. of the piston is represented to be $(X+Y)$, in order to change the combustion chamber pressure and intake port pressure from the atmospheric pressure (1 atmospheric pressure) to −450 mmHg (0.4 atmospheric pressure), it is necessary that $(X/10+Y)/(X+Y)$ equals to 0.4. Therefore, the relation of this equation is represented to be $X=2Y$.

Accordingly, when the intake passage volume is smaller than or equal to ½ of the maximum volume of the combustion chamber, a proper pressure in the combustion chamber is maintained at a state of the B.D.P. of the piston so as to reduce the pumping loss at low engine load condition such as an idle condition.

Figure 10:
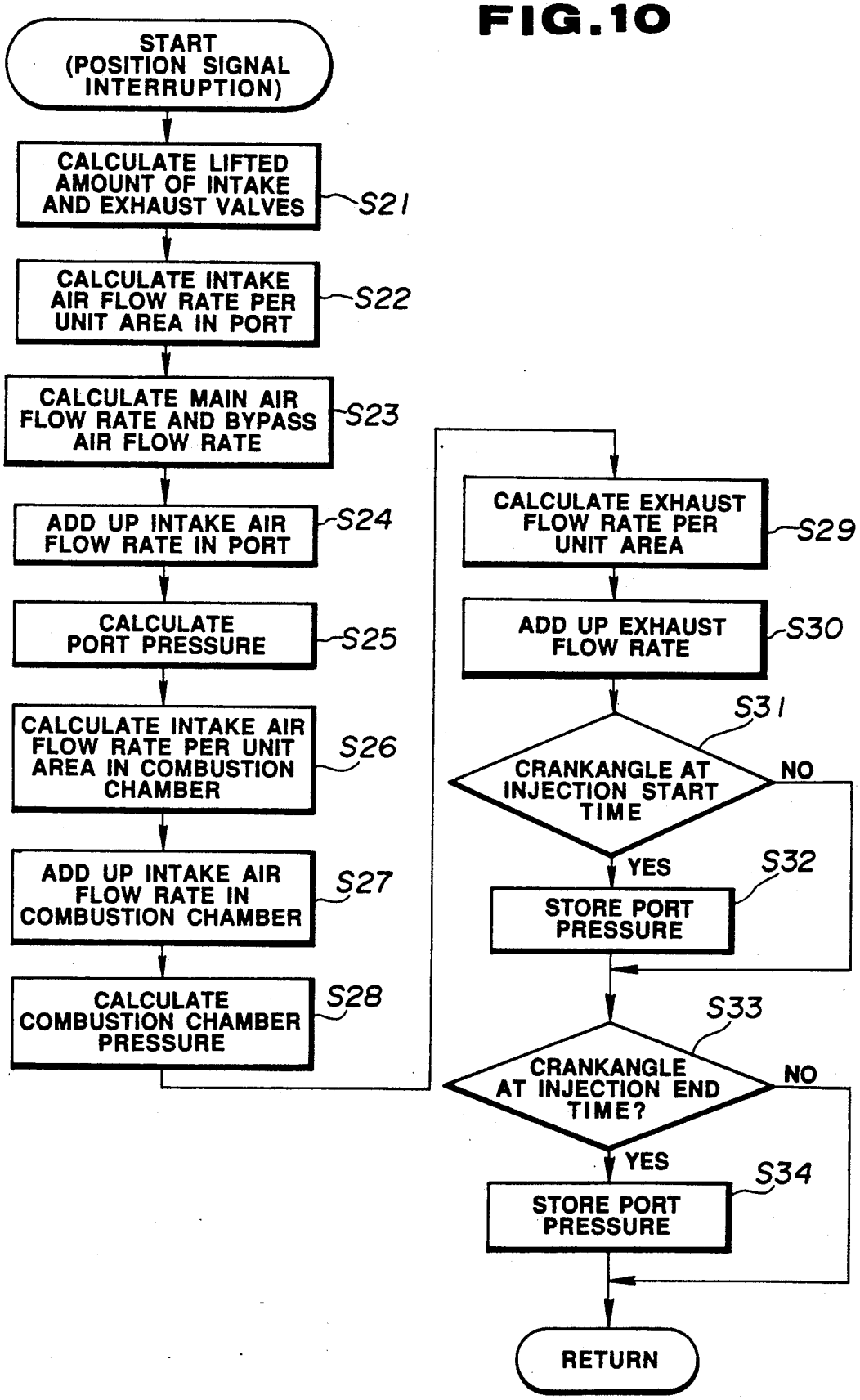
FIG. 10 is a flow chart showing a second embodiment of a program of the fuel supply apparatus according to the present invention.

Referring to a flow chart of FIG. 10, a second embodiment of the present invention will be discussed hereinafter.

The structure of the second embodiment is similar to the first embodiment, in which the controller 6 takes additional steps in the routine which is carried out in response to every position signal.

In a step S21, a rifted amount of the intake valve 3 and a rifted amount of the exhaust valve are calculated in accordance with a reference signal and the position signal.

In a step S22, the controller 6 calculates an inlet air flow rate per unit cross-sectional area at the intake passage 1 downstream of the throttle valve 2 in accordance with the pressure difference between front and aft portions of the throttle valve 2. That is to say, the inlet air flow rate per unit cross-sectional area is searched from the data map memorized in the controller 6 in accordance with the above-discussed pressure difference, and is calculated to be interpolated.

In a step S23, a first inlet flow rate passing through the intake passage and a second inlet flow rate passing through the bypass passage 4 are calculated in accordance with the cross-sectional area of the bypass passage 4, the opening degree of the throttle valve 2 which changes the cross-sectional area of the intake passage 1, and the inlet air flow rate per unit cross-sectional area.

In a step S24, an estimated intake air flow rate amount, which is filled in the intake passage 1, is calculated in accordance with the first and the second inlet air flow rates and a flow rate amount fed into the combustion chamber.

In a step S25, an intake port pressure (the estimated intake air flow rate amount/the port volume) is calculated in accordance with the estimated intake air flow rate amount and the port volume.

In a step S26, a cylinder inlet air flow rate per unit cross sectional area is searched from the data map memorized in the controller 6 in accordance with the difference between the intake port pressure calculated in the step S25 and the combustion chamber pressure detected by the combustion chamber pressure sensor.

In a step S27, the estimated cylinder inlet air flow rate amount is calculated in accordance with the rifted amount of the intake valve 3 and the cylinder inlet air flow rate.

In a step S28, the combustion chamber pressure (the estimated cylinder inlet air flow rate amount/the combustion chamber volume) is calculated in accordance with the estimated cylinder inlet air flow rate amount and the combustion chamber volume.

In a step S29, the outlet air flow rate per unit volume is derived from the data map memorized in the controller 6 in accordance with the pressure difference between the combustion chamber pressure and the pressure in the exhaust passage.

In a step S30, an estimated exhaust air flow rate amount is calculated in accordance with an outlet air flow rate per unit volume and the rifted amount of the exhaust valve (corresponding to the opening area of the exhaust valve).

In a step S31, it is judged whether the present crankangle corresponds to the crankangle at the injection start time or not. When the judgement in the step S31 is "YES", the program proceeds to a step S32. When the judgement in the step S31 is "NO", the program proceeds to a step S33.

In the step S32, the intake port pressure at the injection start time is stored in the RAM of the controller 6.

In the step S33, it is judged whether the present crankangle corresponds to the crankangle at the injection end time or not. When the judgement in the step S33 is "YES", the program proceeds to a step S34. When the judgement in the step S33 is "NO", the routine of the program proceeds to a step "RETURN".

In the step S34, the port pressure at the injection end time is stored in the RAM of the controller 6.

With this operation, the fuel injection time is derived by correcting the basic injection time in accordance with the stored port pressure.

What is claimed is:

1. A fuel supply apparatus for a multiple-cylinder internal combustion engine, the engine having a throttle valve for each intake passage communicated with each cylinder, said fuel supply apparatus comprising:

fuel supply means disposed in the intake passage downstream of each throttle valve for supplying fuel into the intake passage;

fuel supply amount deciding means for deciding a fuel supply amount in accordance with an operating condition of each cylinder;

intake port pressure estimating means for estimating an intake port pressure in the intake passage downstream of each throttle valve in accordance with said operating condition of each cylinder;

fuel supply amount correcting means for correcting the fuel supply amount to each cylinder in accordance with the intake port pressure of each cylinder estimated by said intake port pressure estimating means; and drive controlling means for controlling to drive said fuel supply means in accordance with the corrected fuel supply amount to each cylinder.

2. A fuel supply apparatus as claimed in claim 1, wherein said intake port pressure estimating means estimates the intake port pressure when said fuel supply means is in operation of fuel supply.

3. A fuel supply apparatus for an internal combustion engine, the engine having a throttle valve in an intake passage thereof, comprising:

fuel supply means disposed in the intake passage downstream of each throttle valve for supplying fuel into the intake passage;

fuel supply amount deciding means for deciding a fuel supply amount in accordance with an operating condition of the engine;

intake port pressure estimating means for estimating an intake port pressure in the intake passage downstream of the throttle valve in accordance with said engine operating condition, the intake port pressure at the basic injection start time being looked up in a data map memorized in said intake port pressure estimating means in accordance with an engine speed and a crankangle at the injection start time of said fuel supply means;

fuel supply amount correcting means for correcting the fuel supply amount in accordance with the intake port pressure estimated by said intake port pressure estimating means; and drive controlling means for controlling to drive said fuel supply means in accordance with the corrected fuel supply amount.

4. A fuel supply apparatus for an internal combustion engine, the engine having a throttle valve in an intake passage thereof, comprising:

fuel supply means disposed in the intake passage downstream of each throttle valve for supplying fuel into the intake passage;

fuel supply amount deciding means for deciding a fuel supply amount in accordance with an operating condition of the engine;

intake port pressure estimating means for estimating an intake port pressure in the intake passage downstream of the throttle valve in accordance with said engine operating condition, said intake port pressure estimating means estimating the intake port pressure at a fuel injection start time and the intake port pressure at a fuel injection end time;

fuel supply amount correcting means for correcting the fuel supply amount in accordance with the intake port pressure estimated by said intake port pressure estimating means; and drive controlling means for controlling to drive said fuel supply means in accordance with the corrected fuel supply amount.

5. A fuel supply apparatus as claimed in claim 4, wherein said fuel supply amount correcting means corrects the fuel supply amount in accordance with the averaged value between the intake port pressure at a fuel injection start time and the intake port pressure at a fuel injection end time.

6. A fuel supply apparatus for an internal combustion engine, the engine having a throttle valve in an intake passage thereof, comprising:

fuel supply means disposed in the intake passage downstream of each throttle valve for supplying fuel into the intake passage;

fuel supply amount deciding means for deciding a fuel supply amount in accordance with an operating condition of the engine;

intake port pressure estimating means for estimating an intake port pressure in the intake passage downstream of the throttle valve in accordance with said engine operating condition, said intake port pressure estimating means estimating the intake port pressure in accordance with an engine speed, an opening degree of the throttle valve and a crankangle at the fuel injection start time;

fuel supply amount correcting means for correcting the fuel supply amount in accordance with the intake port pressure estimated by said intake port pressure estimating means; and drive controlling means for controlling to drive said fuel supply means in accordance with the corrected fuel supply amount.

7. A fuel supply apparatus as claimed in claim 1, further comprising an opening-closing valve which is operated to feed air to the intake passage downastream of the throttle valve so as to adjust the intake port pressure into a general atmospheric pressure at a time just before every intake stroke of the engine.

8. A fuel supply apparatus for an internal combustion engine, the engine having a throttle valve in an intake passage thereof, comprising:

fuel supply means disposed in the intake passage downstream of each throttle valve for supplying fuel into the intake passage;

fuel supply amount deciding means for deciding a fuel supply amount in accordance with an operating condition of the engine;

intake port pressure estimating means for estimating an intake port pressure in the intake passage downstream of the throttle valve in accordance with said engine operating condition, said intake port pressure estimating means calculating the intake port pressure in accordance with an inlet air flow rate amount, the volume of the intake passage downstream of the throttle valve to the intake port, and a flow rate amount fed into the combustion chamber of the engine;

fuel supply amount correcting means for correcting the fuel supply amount in accordance with the intake port pressure estimated by said intake port pressure estimating means; and drive controlling means for controlling to drive said fuel supply means in accordance with the corrected fuel supply amount.

9. A fuel supply apparatus for a multiple-cylinder internal combustion engine, the engine having a throttle valve for each intake passage communicated with each cylinder, comprising:

fuel supply means disposed in the intake passage downstream of each throttle valve for supplying fuel into the intake passage;

a controller deciding a basic fuel supply amount in accordance with an operating condition in each cylinder, said controller estimating an intake port pressure in the intake passage downstream of each throttle valve in accordance with the operating condition in each cylinder, said controller correcting the basic fuel supply amount in accordance with the estimated intake port pressure of each cylinder and outputting a signal indicative of the corrected fuel supply amount to each cylinder; and a driver driving said fuel supply means in accordance with the signal from said controller so as to take said fuel supply means and inject the corrected fuel supply amount into the intake passage.

* * * * *